US005730638A

United States Patent [19]

Ward

[11] Patent Number: 5,730,638

[45] Date of Patent: Mar. 24, 1998

[54] REMOVABLE LIGHT AND SOUND MODULE FOR DOLLS

[75] Inventor: Trevor F. Ward, Hawthorne, Calif.

[73] Assignee: Mattel, Inc., El Segundo, Calif.

[21] Appl. No.: 797,794

[22] Filed: Feb. 7, 1997

[51] Int. Cl.[6] ..... A63H 3/28; A63H 33/26; F21L 15/14

[52] U.S. Cl. ..... 446/297; 446/219; 446/485; 362/108; 362/808

[58] Field of Search ..... 446/219, 297, 446/485, 268; 362/103, 108, 808

[56] References Cited

U.S. PATENT DOCUMENTS

| | | | |
|---|---|---|---|
| 1,485,641 | 3/1924 | Sparks . | |
| 2,267,094 | 12/1941 | Halsey . | |
| 2,467,139 | 4/1949 | Links et al. . | |
| 2,579,725 | 12/1951 | Burnbaum | 362/808 |
| 3,205,350 | 9/1965 | Roszkowski et al. . | |
| 3,531,891 | 10/1970 | Goldfarb et al. . | |
| 3,553,885 | 1/1971 | Tazaki . | |
| 4,741,717 | 5/1988 | Wolf . | |
| 4,878,873 | 11/1989 | Yamaguchi et al. . | |
| 4,902,262 | 2/1990 | Lunsford . | |
| 5,003,973 | 4/1991 | Ford et al. | 128/201.25 |
| 5,046,986 | 9/1991 | Wood et al. . | |
| 5,092,810 | 3/1992 | Kwan et al. . | |
| 5,588,895 | 12/1996 | Larson | 446/219 |

FOREIGN PATENT DOCUMENTS

| | | | |
|---|---|---|---|
| 700464 | 3/1931 | France | 446/219 |
| 2503575 | 10/1982 | France . | |
| 808513 | 2/1959 | United Kingdom . | |

*Primary Examiner*—Robert A. Hafer
*Assistant Examiner*—Laura Fossum
*Attorney, Agent, or Firm*—Roy A. Ekstrand

[57] ABSTRACT

A housing includes a clip for attachment of the housing to the back surface of a doll or toy figure. Within the housing, an electronic circuit is operative under battery power to provide audible sounds when an on/off button is pushed. A plurality of light-emitting diodes are operatively coupled to the sound circuit and are energized in a flashing operation when the sound circuit is energized. A cape attachable to the doll upon which the housing is attached includes a reflective surface facing the light-emitting diodes of the housing to provide reflection of the light produced thereby. When the sound circuit is energized, audible sounds are produced and the interior surface of the cape is bombarded with flashing light energy to provide an amusing visual effect. The housing is removable from the host doll and may be worn on a convenient attachment such as a bracelet or the like by the user.

11 Claims, 3 Drawing Sheets

31
30
39
38
40
42
34
41
33

13
12
21
14
10
22
17
33
32
11
34
18
20
36
15
23
24
31
16
30
25

REMOVABLE LIGHT AND SOUND MODULE FOR DOLLS

FIELD OF THE INVENTION

This invention relates generally to doll accessories and particularly to accessories which are removably securable to the doll torso.

BACKGROUND OF THE INVENTION

Dolls and toy figures have enjoyed great popularity for many years and, not surprisingly, have been provided in a great variety of forms and configurations. Accordingly, practitioners in the art have provided dolls and toy figures which range from extremely life-like and realistic to completely unrealistic and fanciful configurations. In addition to the wide variety of dolls and toy figures, practitioners in the art have further endeavored to enhance the popularity of their various dolls and toy figures by providing features or accessories for use in combination therewith. Thus, dolls and toy figures have been provided which include various illumination systems, sound producing systems, as well as battery power apparatus and transportation modules or vehicles.

In some dolls and toy figures, the accessory or module is provided in the form of a removable interactive cooperating unit which is releasibly attachable to the doll or toy figure. Such units are often referred to as doll packs and may be given further descriptive titles such as battery pack or sound pack or the like.

For example, U.S. Pat. No. 5,092,810 issued to Kwan, et al. sets forth a TOY AUDIO DEVICE having a sound generating device for use as an accessory for another toy such as the backpack of a toy action figure. The toy audio device includes a receptacle defining an enclosure containing a speaker, a plurality of batteries and a printed circuit board. The latter supports a sound generating circuit.

U.S. Pat. No. 4,741,717 issued to Wolf sets forth a SMOKE GENERATOR FOR PASSIVE TOY in which a doll supports a smoke generating apparatus within the doll torso which vents smoke outwardly through a body orifice such as the mouth opening. A battery pack for supplying power to the smoke generator is removably secured to the rear side of the doll torso to provide energy for operating the smoke generator.

U.S. Pat. No. 4,902,262 issued to Lunsford sets forth a POWER UNIT AND BATTERY PACK FOR TOYS having a handheld power unit including an electric motor and operative mechanism such as a simulated cutting tool is operative in combination with an external battery pack which supports a plurality of batteries and which is secured to the doll torso by removable straps. The battery pack and electrical motor driven unit are operatively coupled by a plurality of connecting wires.

U.S. Pat. No. 4,878,873 issued to Yamaguchi, et al. sets forth a TOY DOLL having head and trunk portions which are illuminated to project images upon the doll exterior. Illumination is achieved by providing inner cavities of the head and torso portions in communication with a common light source disposed within the doll interior.

Still other variations of dolls have been provided which are illuminated in various fashions. For example, U.S. Pat. No. 3,205,350 issued to Roszkowski, et al. sets forth an ILLUMINATED FIGURINE having a figurine supported upon a hemispherical base and further supporting a translucent halo portion. The halo portion further supports a small electric lamp which is operatively coupled to a battery power supply in the figurine's base.

U.S. Pat. No. 1,485,641 issued to Sparks sets forth a LAMP having a base portion configured to generally resemble a human dancer or the like. The lamp includes a large electric lamp bulb supported within the skirt portion of the doll together with a smaller electric lamp supported within the upper torso of the doll. Switch means are provided for operating either or both of the electric lamps to provide the desired illumination.

U.S. Pat. No. 2,267,094 issued to Halsey sets forth a DOLL having outer clothing which is phosphorescent. As a result, the doll glows in the art in selected areas.

U.S. Pat. No. 5,046,986 issued to Wood, et al. sets forth a DOLL AND COSTUME CONSTRUCTION having a loose fitting garment for use as a costume on a doll or adult. The loose fitting garment is styled for presentation of a first selected character in costume. The loose fitting garment includes on one surface a design corresponding to the style for the first selected character. The opposite or second surface of the garment includes a design representative of a second character. The garment is reversible to convert the costume to one character to another.

U.S. Pat. No. 3,531,891 issued to Goldfarb, et al. sets forth a SWITCH MEANS FOR CONTROLLING AN ANIMATION DEVICE IN A FIGURE TOY having an electrically operated animation means such as light bulbs and a buzzer which is controlled by switch means including a vibratile contact which may be caused to vibrate by flicking a weight carried thereby.

U.S. Pat. No. 2,467,139 issued to Links, et al. sets forth an ANIMATED TOY configured to resemble a dancer and having a rotational support coupling the animated toy to a revolving platform. The animated toy further supports a plurality of fabric elements which are received upon the skirt and shoulder portions of the doll.

U.S. Pat. No. 3,553,885 issued to Tazaki sets forth a TOY ASSEMBLY having a toy figure resembling a space man operative in combination with a simulated space vehicle. The latter includes rolling wheels which are coupled to a drive coupling. The simulated space man includes an internal battery-powered electric motor drive unit having a coupler extending downwardly from the toy figure. When the toy figure is seated within the vehicle, the power coupling to the drive wheels is complete and the toy figure provides rotational power for moving the vehicle.

British Patent 808,513 sets forth IMPROVEMENTS IN OR RELATING TO AMUSEMENT DEVICES having a display unit securable upon the rear portion of a human figure. The display unit includes a plurality of electric lamps which are operatively coupled to a battery power source to provide illumination of the backpack article.

French Patent 2,503,575 sets forth a removable breast plate for wearing on the front torso portion of a human figure. The breast plate supports a pair of illuminated members extending forwardly from the breastplate.

While the foregoing described prior art devices have to some extent improved the art and have in some instances enjoyed commercial success, there remains nonetheless a continuing need in the art for evermore improved interesting and novel accessories for dolls and toy figures.

SUMMARY OF THE INVENTION

Accordingly, it is a general object of the present invention to provide an improved accessory for dolls and toy figures.

It is a more particular object of the present invention to provide an improved accessory for dolls and toy figures which may be alternatively used by child users apart from the doll. It is a still more particular object of the present invention to provide an improved accessory for dolls and toy figures which utilizes both light and sound output for child user stimulation.

In accordance with the present invention, there is provided for use in combination with a doll having a front and a back, a removable module comprising: a housing having a front surface and a rear surface; attachment means for removably securing the housing to the back of the doll at the housing front surface; a plurality of light-producing elements supported by the housing producing light directed generally rearwardly from the rear surface of the housing; electrical means within the housing for energizing the plurality of light-producing elements; and a cape attached to the doll and extending along the doll back and at least partially overlying the plurality of light-producing elements, the cape including a light-reflective frontal surface for reflecting light produced by the light-producing elements forwardly past the doll.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figures 1, 2:
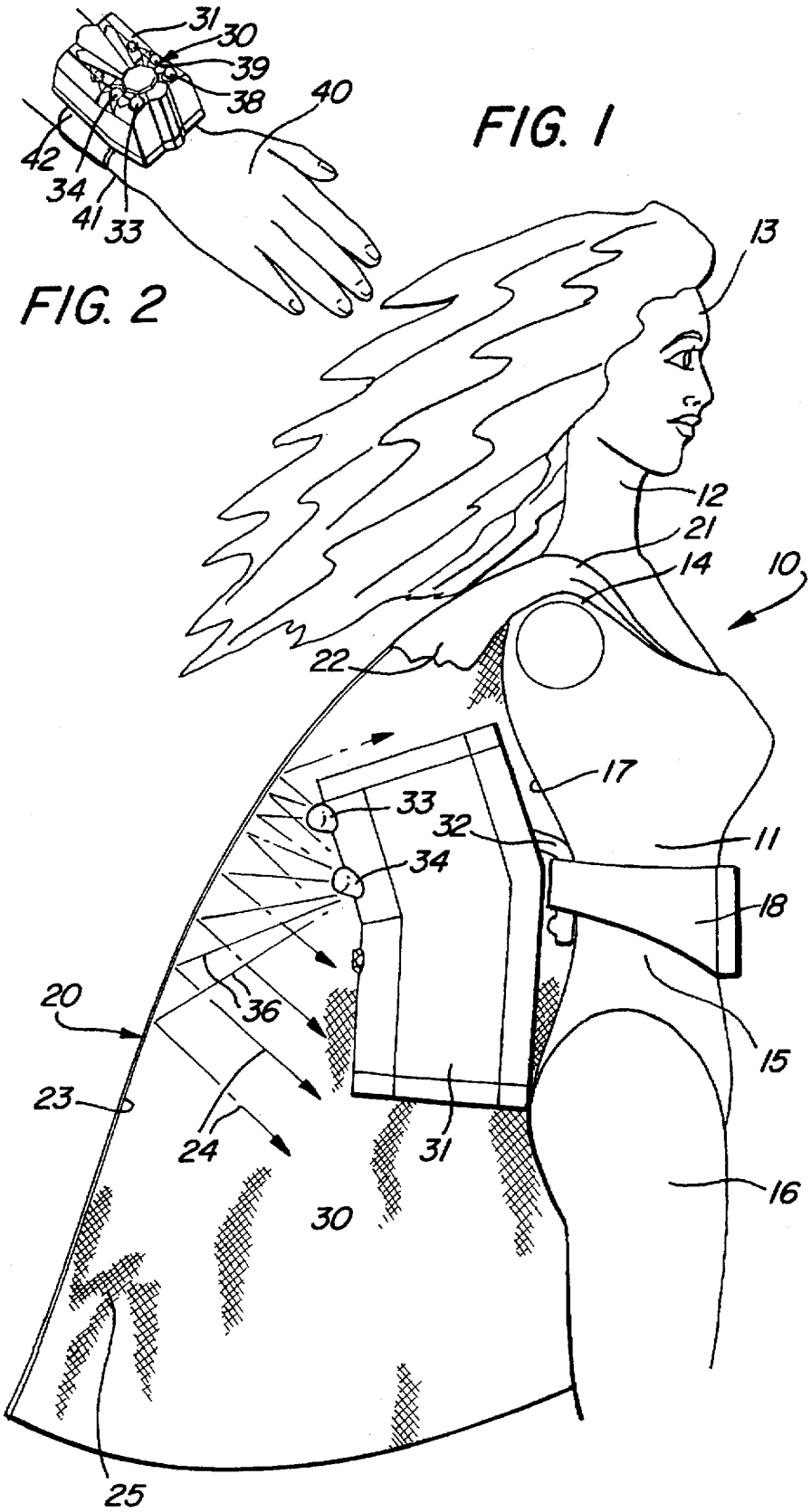
FIG. 1 sets forth a partial sectioned side view of a light and sound module attached to a typical doll or toy figure.
FIG. 2 sets forth a partial perspective view of the present invention light and sound module worn by a child user in an alternative use.

FIG. 1 sets forth a doll generally referenced by numeral 10 having a removable light and sound module constructed in accordance with the present invention and generally referenced by numeral 30. Doll 10 may be fabricated entirely in accordance with conventional fabrication techniques and includes a torso 11 having leg 16 and neck 12 extending therefrom. A shoulder portion 14 extends beneath neck 12. A head 13 is supported upon neck 12 in further accordance with conventional fabrication techniques. Torso 11 defines a narrowed waist portion 15 which in turn receives and supports an encircling belt 18. The latter is sufficiently large with respect to waist 15 to receive clip 32 of module 30.

In accordance with the present invention, doll 10 further receives and supports a cape 20 secured to doll 10 at a shoulder attachment 21 which partially overlies shoulder 14. Attachment 21 may be secured to doll 10 using conventional fabrication techniques. Cape 20 is preferably formed of a relatively flexible fabric type material and thus defines a rear surface 22 facing away from doll 10 and a front surface 23 facing forwardly toward doll 10. In further accordance with the preferred embodiment of the present invention, front surface 23 supports a plurality of reflective elements 25. Reflective elements 25 may be fabricated of a holographic material. Alternatively, reflective elements 25 may be provided by attaching a plurality of small reflective facets formed of a mirror-like material such as mylar or the like. By way of further alternative, reflective elements 25 may comprise a plurality of reflective confetti-like material known generally in the art as "glitter". The important aspect with respect to the present invention of reflective elements 25 is the provision of an extended surface area covering of all or a substantial part of front surface 23 of cape 20.

In further accordance with the present invention, module 30 includes a housing 31 having a clip 32 extending forwardly and downwardly therefrom. As mentioned above, clip 32 is received within belt 18 and is utilized to removably secure module 30 to the rear surface of torso 11. In its preferred fabrication, housing 31 is fabricated of a plurality of molded plastic housing elements in the manner set forth below in FIGS. 4 and 5. Module 30 further includes a plurality of light-emitting diodes 33, 34, 38 and 39 (light-emitting diodes 38 and 39 seen in FIG. 2). Light-emitting diodes 33, 34, 38 and 39 may be fabricated in accordance with conventional fabrication techniques with the essential feature thereof being the production of visible light output when stimulated by electrical signals in the manner described below in FIG. 6 in greater detail. It will be apparent to those skilled in the art, however, that while light-emitting diodes have substantial advantages in terms of light output and efficient use of electrical power, other light-producing devices such as conventional electric lamps or the like may be utilized without departing from the spirit and scope of the present invention.

In operation, module 30 operates in the manner described below in conjunction with FIG. 6 to stimulate light-emitting diodes 33, 34, 38 and 39 with electrical signals having relatively rapid on and off cycles to cause the light-emitting diodes to rapidly energize and deenergize. The result of such rapid stimulation of light-emitting diodes 33, 34, 38 and 39 is the output of flashing light rays 36 which are directed rearwardly from module 30 and which impact and reflect from reflective elements 25 of front surface 23. When viewed from the front of doll 10, the operation of module 30 in flashing the plurality of light-emitting diodes or other light sources operative thereon against the plurality of reflective elements upon front surface 23 of cape 20 results in the creation of a novel and entertaining visual effect within cape 20 surrounding the torso of doll 10. In addition and in accordance with the operation of FIG. 6 set forth below in greater detail, module 30 further supports a sound producing apparatus which causes the creation of a predetermined set of audible sounds to be produced and directed outwardly from module 30. The combined effect of module 30's sound production and flashing light is the creation of a novel and exciting play pattern for doll 10.

In further accordance with the present invention, module 30 is removable from belt 18 of doll 10 to facilitate the use of module 30 in alternative play patterns.

FIG. 2 sets forth a perspective view of the present invention light and sound module utilized in an exemplary alternative play pattern. Thus, as is seen in FIG. 2, a user having a hand 40 and a wrist 41 is able to receive and wear module 30 using a simple bracelet 42. Bracelet 42 in its simplest form may comprise a simple fabric band attachable to the wearer's wrist. Alternatively, bracelet 42 may be formed of a molded plastic unit similar to a wrist band or conventional watch band. The important aspect of bracelet 42 is the provision of a convenient attachment for wearing module 30 upon the wearer's wrist. As described above, module 30 includes a housing 31 which in turn supports a plurality of light-emitting diodes 33, 34, 38 and 39. The operation of module 30 is carried forward in the same manner as described above for use in conjunction with doll 10. Accordingly, module 30 operates in the manner set forth below in FIG. 6 in greater detail. However, suffice it to note here that module 30 produces sound output as well as rapid flashing of light-emitting diodes 33, 34, 38 and 39 when operated. This provides an amusing accessory for a child user to wear upon the wrist or other convenient locations.

Figure 3:
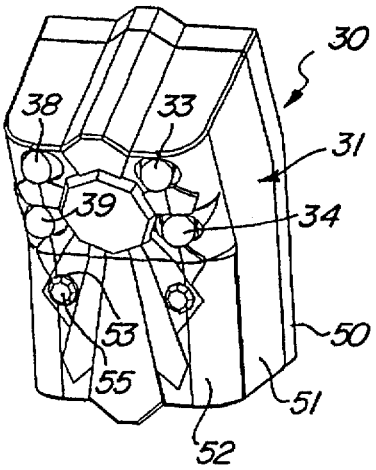
FIG. 3 sets forth a rear perspective view of the present invention removable light and sound module.

FIG. 3 sets forth a rear perspective view of light and sound module 30. As described above, module 30 includes a housing 31 supporting a plurality of light-emitting diodes 33, 34, 38 and 39. Housing 31 is formed of a base 50 having a cover 51 secured thereto which in turn receives and supports a removable battery door 52. In the manner set forth below in FIGS. 4 and 5, base 50 receives and supports cover 51 while battery door 52 is removably secured to cover 51. In accordance with the preferred fabrication of the present invention, cover 51 defines an angled upper portion which supports light-emitting diodes 33, 34, 38 and 39 in a slightly downwardly angled orientation with respect to doll 10 (seen in FIG. 1). This angular position of the light-emitting diodes within module 30 provides a more efficient light output reflection characteristic for increased effect when used in combination with cape 20.

Figure 4:
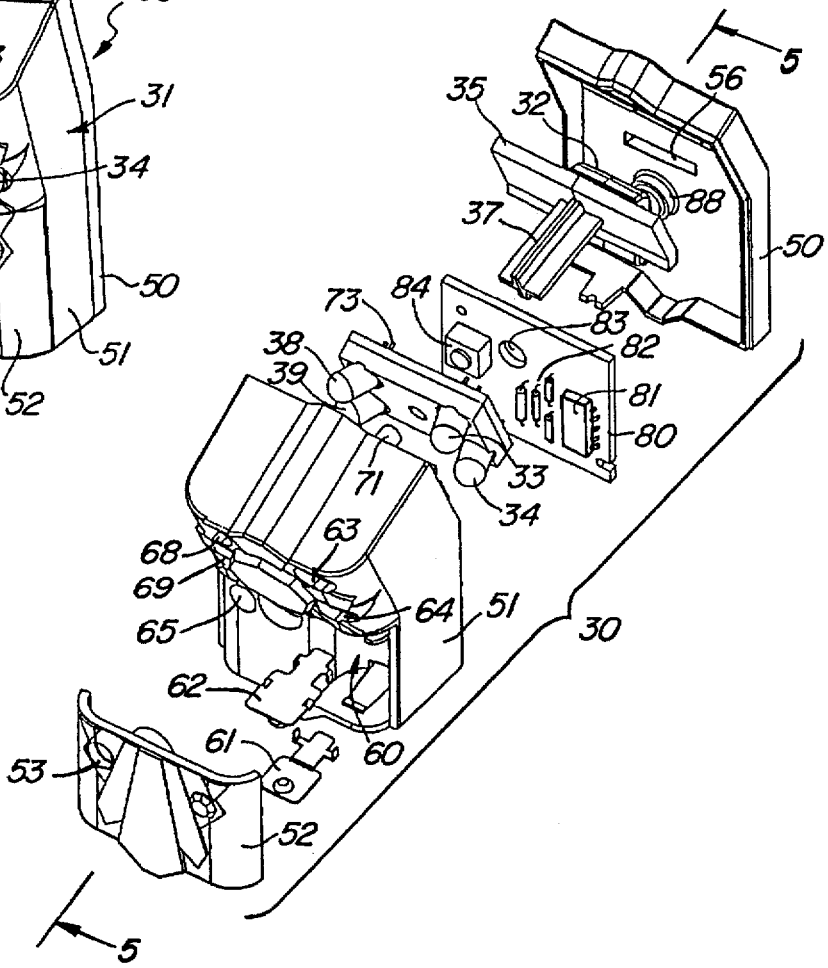
FIG. 4 sets forth a perspective assembly view of the present invention removable light and sound module.

FIG. 4 sets forth a perspective assembly view of module 30. Module 30 includes a housing 31 formed of a base 50, a cover 51 and a battery door 52. As is described above, base 50, cover 51 and battery door 52 are preferably fabricated of molded plastic units joined using conventional fabrication techniques such as adhesive bonding or thermal welding or the like. Battery door 52 is preferably snap-fitted to cover 51 to provide easy removal and access for battery replacement. Base 50 defines a horizontally extending slot 56 which receives clip 32 in the manner best seen in FIG. 5. Clip 32 is supported by a horizontal plate 35 and further supports an inwardly extending cruciform-shaped extension 37. Module 30 further includes a generally planar circuit board 80 fabricated in accordance with conventional fabrication techniques which supports the sound producing circuit shown in FIG. 6. Thus, circuit board 80 supports an integrated circuit 81 and a plurality of associated components 82 (shown in schematic diagram in FIG. 6). Circuit board 80 further defines an aperture 83 and supports a push button switch 84. Module 30 further includes a light-emitting diode support module 70 having a plurality of light-emitting diodes 33, 34, 38 and 39 supported thereon. Module 70 further defines an aperture 72 while light-emitting diodes 33, 34, 38 and 39 include connecting pins 73 extending through module 70. By means not shown but in accordance with conventional fabrication techniques, interconnections are provided between pins 73 of the light-emitting diodes of module 70 and circuit board 80 to provide the circuit configuration shown in schematic detail in FIG. 6.

Cover 51 defines a plurality of apertures 63, 64, 68 and 69 which are spaced in correspondence to the spacing of light-emitting diodes 33, 34, 38 and 39 are of sufficient size to allow the extension of the light-emitting diodes therethrough. Cover 51 further defines an aperture 65 and a battery compartment 60. Within battery compartment 60, a pair of spring force electrical contacts 61 and 62 are snap-fitted in accordance with conventional fabrication techniques. While not seen in FIG. 4, it will be understood that contacts 61 and 62 are operatively coupled to circuit board 80 in the manner indicated in the circuit diagram of FIG. 6 by conventional electrical wiring to provide battery power to circuit board 80. As is better seen in FIG. 5, a conventional battery 66 is received within battery compartment 60 between contacts 61 and 62.

Battery door 52 is, as is mentioned above, preferably snap-fitted to cover 51 or secured by other convenient means to overlie battery compartment 60. Battery door 52 defines an aperture 53 aligned with aperture 65 of cover 51.

Module 30 is assembled by initially fitting clip 32 through slot 56 of base 50 such that plate 35 rest against base 50 and extension 37 extends inwardly. Thereafter, circuit board 80 is assembled beneath plate 35 within base 50 with aperture 83 being received upon post 88 of base 50. Thereafter, light-emitting diode module 70 is fitted into cover 51 such that light-emitting diodes 33, 34, 38 and 39 extend through apertures 63, 64, 68 and 69 respectively. Cover 51 is then assembled to base 50 and secured by conventional fabrication techniques (not shown). Finally, battery 66 (seen in FIG. 5) is positioned within battery compartment 60 and battery door 52 is snap-fitted upon cover 51. To facilitate the actuation of switch 84, an on/off button 55 (seen in FIGS. 3 and 5) is positioned within cover 51 extending through aperture 65 of cover 51. As is better seen in FIG. 5, button 55 includes a rearwardly extending post 57 which extends to switch 84 to provide actuation of switch 84 when button 55 is pushed. The outer end of button 55 extends through aperture 65 of cover 51 and aperture 53 of battery door 52 when module 30 is fully assembled. Thus, with temporary reference to FIG. 3, it will be noted that on/off button 55 is conveniently positioned on the rear surface of battery door 52 and may be pushed to provide actuation of the on/off switch within the circuit of FIG. 6.

Figure 5:
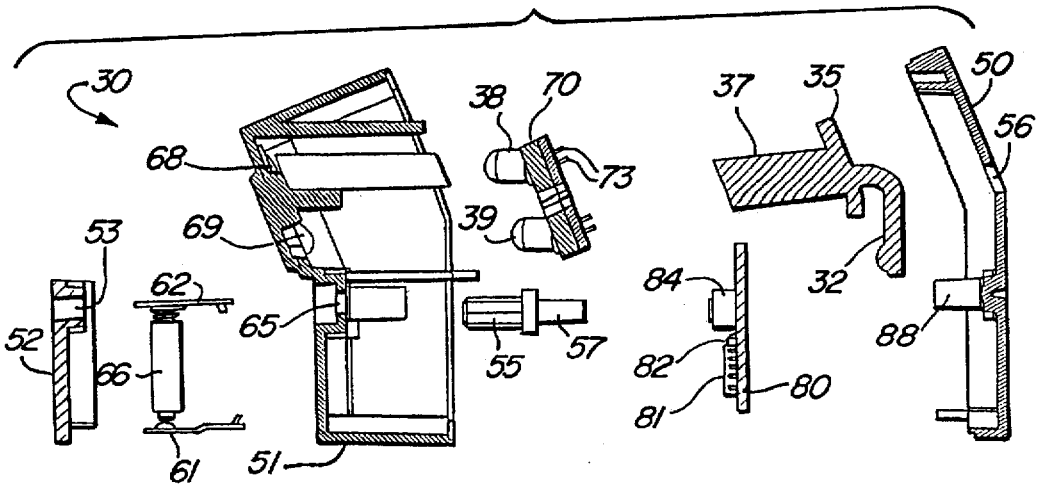
FIG. 5 sets forth a sectioned assembly view of the present invention removable light and sound module.

FIG. 5 sets forth a section assembly view of module 30 taken along section lines 5—5 in FIG. 4. As described above, module 30 includes a base 50 defining a slot 56 and a post 88. As is also described above, clip 32 is supported by a plate 35 together with an extension 37 such that clip 32 is passed through slot 56 and thus supported upon base 50. Circuit board 80 supports a plurality of circuit components 82 and an integrated circuit 81. Circuit board 80 further supports an on/off switch 84 and is received upon post 88 through an aperture 83 (seen in FIG. 4). A light-emitting diode module 70 includes a plurality of light-emitting diodes including diodes 38 and 39 having extending pins 73 to facilitate electrical connection to circuit board 80. Cover 51 is received upon base 50 captivating an elongated push button 55 having a post 57 and light-emitting diode module 70. The latter is supported within cover 51 such that the respective light-emitting diodes thereof extend through corresponding apertures such as apertures 68 and 69 formed in cover 51. Button 55 extends through an aperture 65 formed in cover 51 and is positioned such that post 57 is in contact with the push button of switch 84.

The assembly of module 30 is completed by inserting contacts 61 and 62 into cover 51 and receiving a conventional battery 66 therebetween. After battery installation, battery door 52 having aperture 53 formed therein is secured to cover 51. Aperture 53 is aligned with aperture 65 to facilitate the extension of button 55 therethrough in the manner seen in FIG. 3. The completed assembly provides a fully self-sufficient module useful for attachment to an otherwise conventional doll in the manner shown in FIG. 1 or is preferably operable in combination with a reflective cape such as cape 20 also seen in FIG. 1. By further alternative, module 30 is useful independent of a doll or cooperating cape by being worn by a child user in the manner indicated in FIG. 2.

Of particular amusement value and interest in the operation of the present invention light and sound module is the use thereof in combination with reflective cape 20. When so used, the rapidly flashing light provided by the light-emitting diodes of module 30 are multiply reflected by reflective elements within cape 20 (seen in FIG. 1) to simulate a flame or flash such as that provided by a fanciful rocket booster or flight object thereby providing enhanced play value for the child user.

Figure 6:
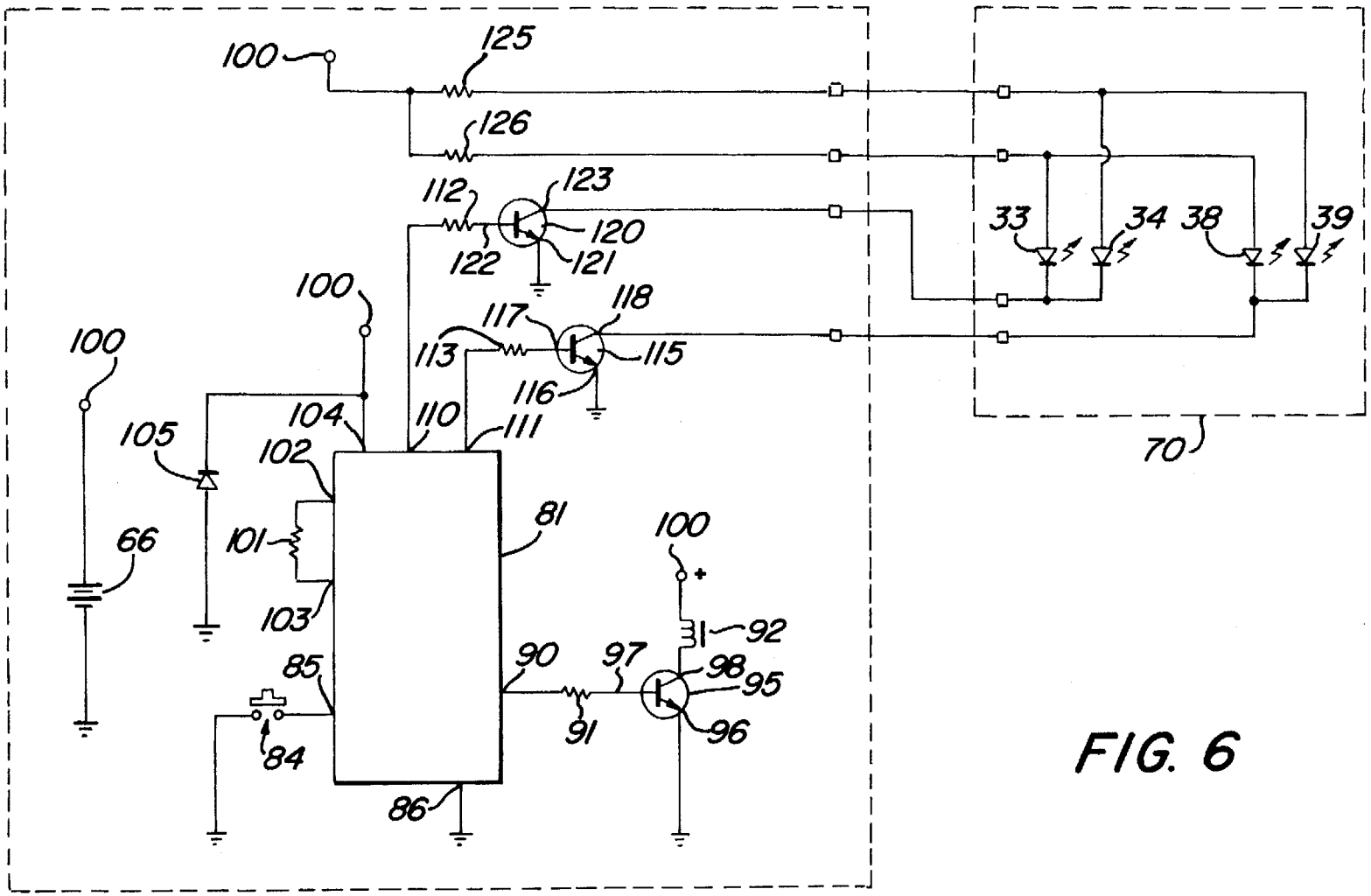
FIG. 6 sets forth a schematic diagram of the light and sound effect producing circuit of the present invention light and sound module for dolls.

FIG. 6 sets forth a schematic diagram of the operative circuit used in module 30 together with light-emitting diode module 70. At the heart of the circuit of FIG. 6 is an integrated circuit 81 which is fabricated in accordance with conventional fabrication techniques and includes a conventional sound effects integrated circuit such as a device generally known by the device designation HT-2887G. However, it will be apparent to those skilled in the art that a variety of conventional integrated circuit sound "chips" may be utilized without departing from the spirit and scope of the present invention. Integrated circuit 81 includes an audio output terminal 90, a pair of periodic signal outputs 110 and 111, a power supply input 104 and a pair of oscillator timing element connections 102 and 103. Integrated circuit 81 further includes a switch input 85 and a ground connection 86. A resistor 101 is coupled between inputs 102 and 103 and a push button switch 84 is coupled between input 85 and ground. An NPN transistor 95 includes an emitter 96 coupled to ground, a base 97 coupled to sound input 90 by a resistor 91 and a collector 98. The latter is coupled to a source of operating supply 100 by an audio transducer 92. Audio transducer 92 comprises a conventional electro-acoustic transducer such as a small speaker or the like for converting electrical signals to audible sound. A battery 66 provides operative power and includes a power supply terminal 100. Power supply terminal 100 is coupled to input 104 of integrated circuit 81 and a protective diode 105 is coupled between terminal 104 and ground. A driver transistor 115 comprises an NPN transistor having an emitter 116 coupled to ground, a base 117 coupled to output 111 by a resistor 113 and a collector 118. A second driver transistor 120 comprises an NPN transistor having an emitter 121 coupled to ground, a base 122 coupled to output 110 by a resistor 112, and a collector 123.

Light-emitting diode module 70 includes a pair of light-emitting diodes 33 and 34 each having their respective cathodes coupled to collector 123 of transistor 120 and a second pair of light-emitting diodes 38 and 39 having their respective cathodes coupled to collector 118 of transistor 115. A resistor 125 couples operating supply terminal 100 to the anodes of the light-emitting diodes 34 and 39 while a resistor 126 couples supply terminal 100 to the anodes of light-emitting diodes 33 and 38. This coupling of light-emitting diodes 33, 34, 38 and 39 provides an improved flashing action as the diodes are variously fired in the operation of integrated circuit 81.

In operation, integrated circuit 81 includes a plurality of stored electrical signals corresponding to the desired audio output and upon the actuation of switch 84, applies the stored audio representative signals to base 97 of transistor 95. Transistor 95 provides power gain for the applied audio signals and drives audio transducer 92 to produce audible sound. Concurrently, the actuation of switch 84 causes integrated circuit 81 to apply a plurality of pulse signals to bases 117 and 122 of driver transistors 115 and 120. The series of applied pulses at transistors 115 and 120 cause corresponding conduction periods for the driver transistors coupling the cathodes of light-emitting diodes 33, 34, 38 and 39 to ground during the brief intervals of driver transistor conduction. Thus, as high speed pulse signals are applied to driver transistors 115 and 120, light-emitting diodes 33, 34, 38 and 39 are rapidly turned on and off producing high speed bursts of light energy or a flashing effect. Each time transistors 115 and 120 are switched to an off condition, the conduction of light-emitting diodes is interrupted and is restored each time the transistors are returned to their conductive state.

What has been shown is a removable light and sound module for dolls which utilizes a cooperating reflective cape to provide a substantially improved amusement activity for the child user. The module is removable from the doll and may be used independent of the doll or cape by, for example, being worn upon the wrist or arm of the child user. The amusing effect provided by the flashing of light-emitting diodes against the cape is optimized by providing a reflective material upon the cape interior surface. The light and sound module is independently powered by an internal battery and is operative independent of the doll or other power source.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A removable module including a cap and a housing for use in combination with a doll having a front and a back, the module comprising:

a housing having a front surface and a rear surface;

attachment means for removably securing said housing to the back of the doll at said housing front surface;

a plurality of light-producing elements supported by said housing producing light directed generally away from said rear surface of said housing;

electrical means within said housing for energizing said plurality of light-producing elements; and a cape designed to be attached to said doll and to extend along said doll back, at least partially overlying said plurality of light-producing elements, said cape including a light-reflective frontal surface designed to reflect light produced by said light-producing elements forwardly past said doll, when said cape is attached to said doll and extends along said doll back.

2. A removable module as set forth in claim 1 wherein said housing further includes sound producing means for producing audible sounds when said plurality of light-producing elements are energized.

3. A removable module as set forth in claim 2 wherein said cape is formed of a generally flexible fabric and wherein said light-reflective frontal surface includes a plurality of reflective elements attached to said fabric.

4. A removable module as set forth in claim 3 wherein said plurality of light-producing elements are light-emitting diodes.

5. A removable module as set forth in claim 4 wherein said housing includes downwardly angled portion supporting said light-emitting diodes to direct light produced thereby at a downward angle with respect to said cape.

6. A removable module as set forth in claim 5 wherein said housing includes a base, a cover received upon said base and defining a battery compartment and a cover overlying said battery compartment.

7. A module for use with a doll having a doll body, the module comprising:

a cape having a light reflective surface and means for attachment to the doll body; and light means adapted to attach to the doll body for producing flashing light directed toward said light reflective surface configured to produce reflected light flashing about said doll body when said cape and said light means are attached to the doll body.

8. A module as set forth in claim 7 wherein said light means are configured to be attached to a back of said doll and said cape is designed to overlie said doll back and said light means when attached to the doll body.

9. A module as set forth in claim 8 further including sound means for producing audible sound.

10. A module as set forth in claim 9 wherein said light means includes a plurality of light-emitting diodes and means for energizing said light-emitting diodes periodically.

11. A module as set forth in claim 10 wherein said light reflective surface of said cape includes a plurality of faceted reflective particles.

* * * * *